US007396121B2

(12) United States Patent
Kawai et al.

(10) Patent No.: US 7,396,121 B2
(45) Date of Patent: Jul. 8, 2008

(54) INK-JET PRINTER

(75) Inventors: Ryoichi Kawai, Nara (JP); Hideo Uwagaki, Kyoto (JP); Hiromitsu Tsutsui, Nara (JP); Nobuyuki Nakamura, Nara (JP); Shigeo Miyamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 398 days.

(21) Appl. No.: 10/557,183

(22) PCT Filed: May 19, 2004

(86) PCT No.: PCT/JP2004/006742

§ 371 (c)(1),
(2), (4) Date: Nov. 17, 2005

(87) PCT Pub. No.: WO2004/113209

PCT Pub. Date: Dec. 29, 2004

(65) Prior Publication Data

US 2006/0232653 A1 Oct. 19, 2006

(30) Foreign Application Priority Data

May 21, 2003 (JP) ..... 2003-144074

(51) Int. Cl.
*B41J 2/01* (2006.01)

(52) U.S. Cl. ..... 347/101; 400/625; 399/365

(58) Field of Classification Search ..... 347/101, 347/104; 400/624–625
See application file for complete search history.

(56) References Cited

U.S. PATENT DOCUMENTS

| | | | | |
|---|---|---|---|---|
| 5,847,719 | A * | 12/1998 | Yamaguchi et al. | 346/134 |
| 5,940,092 | A * | 8/1999 | Kashimura et al. | 347/8 |
| 6,655,864 | B2 * | 12/2003 | Saito | 400/642 |
| 2001/0017635 | A1 * | 8/2001 | Kan et al. | 347/22 |
| 2002/0126192 | A1 * | 9/2002 | Kawaguchi et al. | 347/104 |

FOREIGN PATENT DOCUMENTS

| | | | |
|---|---|---|---|
| JP | 5-186086 | A | 7/1993 |
| JP | 7-33279 | A | 2/1995 |
| JP | 10-310279 | A | 11/1998 |
| JP | 11-208923 | A | 8/1999 |
| JP | 2002-154701 | A | 5/2002 |
| JP | 2002-326755 | A | 11/2002 |

* cited by examiner

*Primary Examiner*—Walter Benson
*Assistant Examiner*—Jeffrey Baker
(74) *Attorney, Agent, or Firm*—Birch, Stewart, Kolasch & Birch, LLP

(57) ABSTRACT

An ink jet printer has two first driven rollers (A) disposed at a most upstream position in a secondary scanning direction, two first driven rollers (B) disposed at an intermediate position in the secondary scanning direction, and a single first driven roller (C) disposed at a most downstream position in the secondary scanning direction. The pressing force on a trailing edge of the recording sheet (10) is dividedly released in three steps sequentially and, accordingly, the nipping force and feeding force working on the recording sheet (10) also vary stepwise. Load fluctuations that occur at the moment the trailing edge of the recording sheet (10) is released from the nipping force of the first transport roller (4) also vary stepwise, whereby it is not possible that the feed precision is disturbed in a moment.

4 Claims, 4 Drawing Sheets

Related Art

Related Art

INK-JET PRINTER

TECHNICAL FIELD

The present invention relates to an ink jet printer configured to perform printing by jetting ink while feeding recording paper sheets (including recording media other than paper).

BACKGROUND ART

FIG. 3 is a perspective view showing a conventional ink jet printer and FIG. 4 is a side view of the conventional ink jet printer. In FIGS. 3 and 4, a recording sheet fed by a non-illustrated pickup roller is nipped between a transport roller 4' and a driven roller A' and then moved a predetermined distance toward the left-hand side in the figure (in the secondary scanning direction). Subsequently, an ink head 12' held by a carriage 2' disposed downstream of the transport roller 4' in the secondary scanning direction jets ink against the surface of the recording sheet while reciprocating in the primary scanning direction orthogonal to the secondary scanning direction. While intermittent feeding of the recording sheet in the secondary scanning direction and movement of the ink head 12' in the primary scanning direction are repeated, an image forming operation continues. In response to detection of the trailing edge of the recording sheet just short of passing through the nip point of the transport roller 4' by a non-illustrated sheet sensor, the ink head 12' stops moving in the primary scanning direction. Finally, an ejection roller 10' ejects the recording sheet out of the apparatus.

In this case, a blank of a distance X in which an image is not formed is produced in a trailing edge portion of the recording sheet, the distance X corresponding to the spacing between the nozzle position of the ink head 12' and the nip point of the transport roller 4'. This results in a drawback that the image forming region of the recording sheet is limited in the trailing edge portion.

In recent years, some printers have been given the capability of forming an image on a recording sheet up to the trailing edge thereof without producing a blank. Mechanical measures devised for such apparatus to implement that function include: an arrangement configured to lower the sheet feed speed only for image formation on a portion of a recording sheet adjacent the sheet trailing edge; an arrangement made less susceptible to the influence of load fluctuations that occur at the moment the trailing edge of a recording sheet passes through the transport roller by increasing the sheet nipping pressure of an ejection roller section; an arrangement provided with a mechanism for suppressing backlash in driving the transport roller by a pressure produced by a spring; and an arrangement using parts, such as rollers, manufactured with an improved machining precision.

These apparatus, however, have a drawback of incurring complication of image formation control and increase in the costs of parts because they are also configured to perform high-quality image formation based mainly on the dot-jetting control technology. On the other hand, even in the case where attention is focused on the leading edge portion of a recording sheet under feeding in FIG. 4, load fluctuations occur at the moment the leading edge of the recording sheet rushes to an ejection driven roller 7' which is configured to nip the recording sheet in cooperation with the ejection roller 5' by exerting a pressing force on the ejection roller 5', as in the case of the trailing edge portion. Such load fluctuations make the feed distance unstable, which results in degraded image quality such as color irregularity. A conventional ejection driven roller arrangement generally includes a plurality of such ejection driven rollers 7' arranged in a row in the primary scanning direction. Accordingly, at the time the recording sheet rushes to the row of these ejection driven rollers 7', pressing forces of all the ejection driven rollers 7' are exerted on the leading edge of the recording sheet at a time, thus greatly affecting the sheet feed precision. It is needless to say that this phenomenon becomes more serious as the pressing force of each ejection driven roller 7' increases.

In attempt to prevent irregular image formation at the trailing edge portion of a recording sheet, there have been proposed an arrangement wherein two types of materials, i.e., a soft material and a hard material, are used for the material of a first driven roller and two rows of such first driven rollers are arranged in the secondary scanning direction, and an arrangement wherein an auxiliary member for pressing against a recording sheet irrespective of the material and shape thereof is disposed downstream of the first driven roller (see patent document 1 for example). However, there is neither any mention of an arrangement of driven rollers of the same material in the primary scanning direction, nor any description of an arrangement of driven rollers pressing against ejection rollers. There has also been proposed an arrangement for a pressure control such as to release or substantially release the pressure of a driven roller pressing against a transport roller halfway through a printing operation (see patent documents 2 and 3 for example).

However, in a conventional ink jet printer which does not utilize the high-precision dot control technology, the amount of a feed or move of a recording sheet fluctuates due to fluctuations in the load on the sheet feed force which occur at the moment the trailing edge of the recording sheet passes through the transport roller, so that a line deviation occurs in the secondary scanning direction, thus causing a problem of degraded image quality such as color irregularity. Likewise, the sheet feed precision is affected at the time the leading edge of the recording sheet rushes to the ejection driven roller, thus resulting in degraded image quality such as color irregularity.

An object of the present invention is to provide an ink jet printer which can ensure improved image quality without incurring complication of image formation control and increase in cost.

Patent Document 1: Japanese Patent Laid-Open Publication No. H05-186086

Patent Document 2: Japanese Patent Laid-Open Publication No. H07-033279

Patent Document 3: Japanese Patent Laid-Open Publication No. H11-208923

DISCLOSURE OF THE INVENTION

The present invention includes the following arrangements as means for solving the foregoing problems.

(1) An ink jet printer comprising: a first transport roller to be driven in a sheet feed direction in which a recording sheet is to be fed; plural first driven rollers configured to press the recording sheet against the first transport roller to nip the recording sheet therebetween; a second transport roller to be driven in the sheet feed direction at location downstream of the first transport roller in the sheet feed direction; plural second driven rollers configured to press the recording sheet against the second transport roller to nip the recording sheet therebetween; and an ink head configured to jet ink against the recording sheet while moving in a direction orthogonal to the sheet feed direction between the first transport roller and the second transport roller in the sheet feed direction, the jetting of ink against the recording sheet by the ink head being continued even after passage of a trailing edge of the recording sheet between the first transport roller and the first driven rollers, wherein:

biasing members each configured to exert a biasing force on a respective one of the plural first driven rollers in such a direction as to press the respective one of the plural first driven roller against the first transport roller are disposed at different positions in the direction orthogonal to the sheet feed direction; and nip points between the first transport roller and the first driven rollers are located at respective positions in the sheet feed direction in such a manner as to take respective positions in the direction orthogonal to the sheet feed direction which are substantially symmetric with respect to a center line of the recording sheet parallel with the sheet feed direction.

In this arrangement, the pressure contact points (nip points) between the first transport roller and first driven rollers located upstream of the ink head in the sheet feed direction are located at different positions in the sheet feed direction in such a manner as to take respective positions in the direction orthogonal to the sheet feed direction which are substantially symmetric with respect to a center line of the recording sheet parallel with the sheet feed direction. Accordingly, during passage of the trailing edge of the recording sheet between the first transport roller and the first driven rollers, the pressing force against the recording sheet is released gradually and equally in the direction orthogonal to the sheet feed direction. For this reason, the recording sheet can be fed smoothly during the passage of its trailing edge between the first transport roller and the first driven rollers. Thus, the condition of an image formed on the trailing edge portion of the recording sheet can be prevented from being degraded notwithstanding the fact that the ink head continues to jet ink against the recording sheet during that period, whereby satisfactory image quality can be ensured.

(2) The biasing forces of the plural biasing members are established such that a group consisting of a single or plural first driven rollers taking the same position in the sheet feed direction exerts a total pressing force on the first transport roller which decreases as the location of the group goes downstream in the sheet feed direction.

In this arrangement, a group consisting of a single or plural first driven rollers taking the same position in the sheet feed direction exerts a total pressing force on the first transport roller which decreases as the location of the group goes downstream in the sheet feed direction. Accordingly, during passage of the trailing edge of the recording sheet through plural nip points in the sheet feed direction, fluctuations in the load on the recording sheet are reduced gradually. Thus, the recording sheet can be fed more smoothly during the passage of its trailing edge between the first transport roller and the first driven rollers.

(3) The plural second driven rollers are disposed at different positions in the sheet feed direction and plural second driven rollers are arranged in the direction orthogonal to the sheet feed direction at at least a most upstream one of the different positions.

In this arrangement, the nip points between the second transport roller and second driven rollers located downstream of the ink head in the sheet feed direction are located at different positions in the sheet feed direction. Accordingly, during passage of the leading edge of the recording sheet between the second transport roller and the second driven rollers, the pressing force against the recording sheet increases gradually. Thus, the recording sheet can be prevented from being subjected to large load fluctuations during passage of its leading edge between the second transport roller and the second driven rollers, whereby the recording sheet can be fed smoothly.

(4) The pressing forces of the plural second driven rollers are established such that a most upstream one of groups of second driven rollers in the sheet feed direction exerts a smallest total pressing force on the second transport roller, the groups each consisting of a single or plural second driven rollers taking the same position in the sheet feed direction.

In this arrangement, a most upstream one of groups of second driven rollers in the sheet feed direction exerts a smallest total pressing force on the second transport roller, the groups each consisting of a single or plural second driven rollers taking the same position in the sheet feed direction. Accordingly, during passage of the leading edge of the recording sheet through the most upstream one of the nip points between the second transport roller and the second driven rollers in the sheet feed direction, the recording sheet is prevented from being subjected to excessive load fluctuations.

BEST MODE FOR CARRYING OUT THE INVENTION

Figure 1:
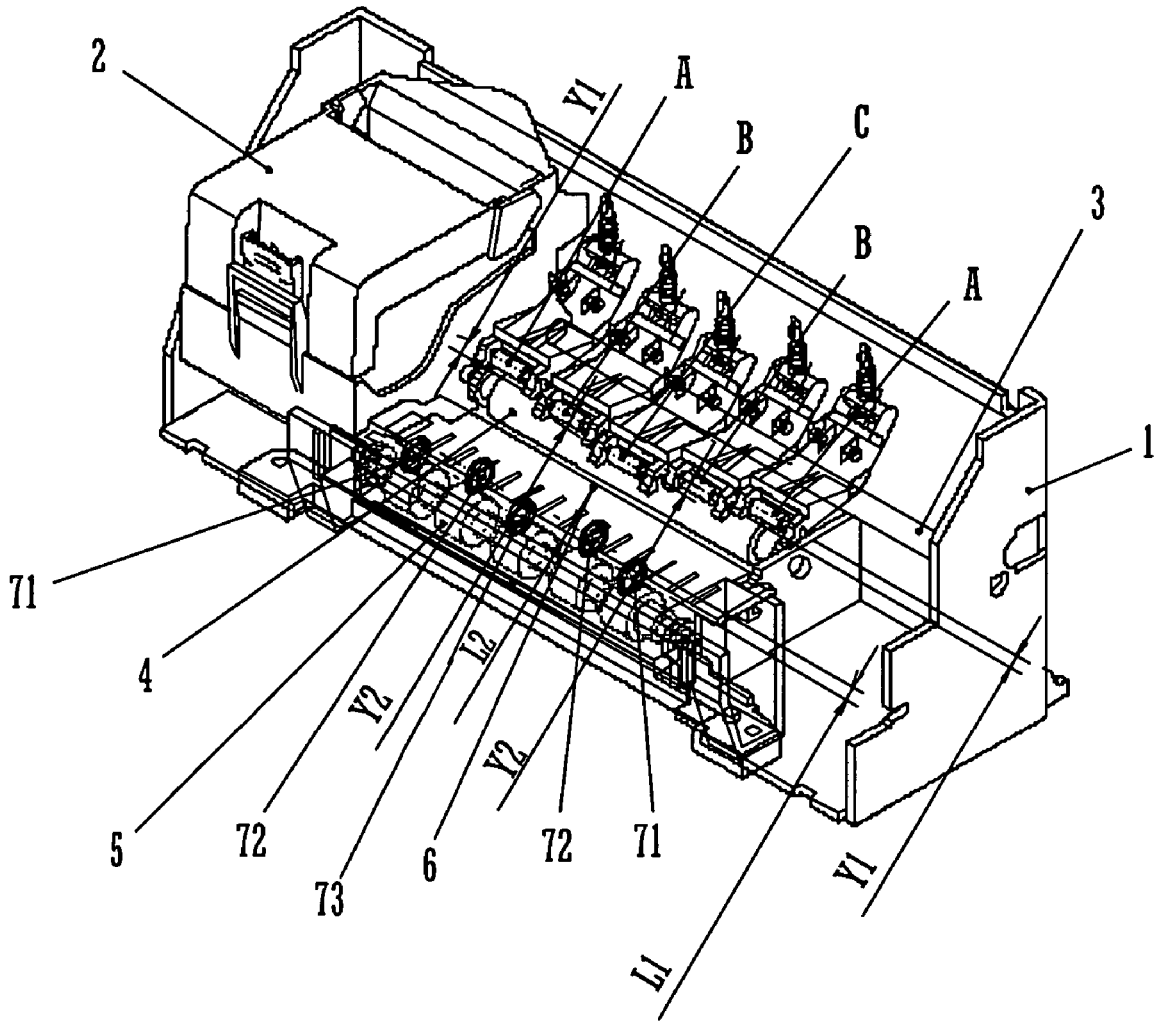
FIG. 1 is a perspective view showing an ink jet printer according to an embodiment of the present invention.
Figure 2:
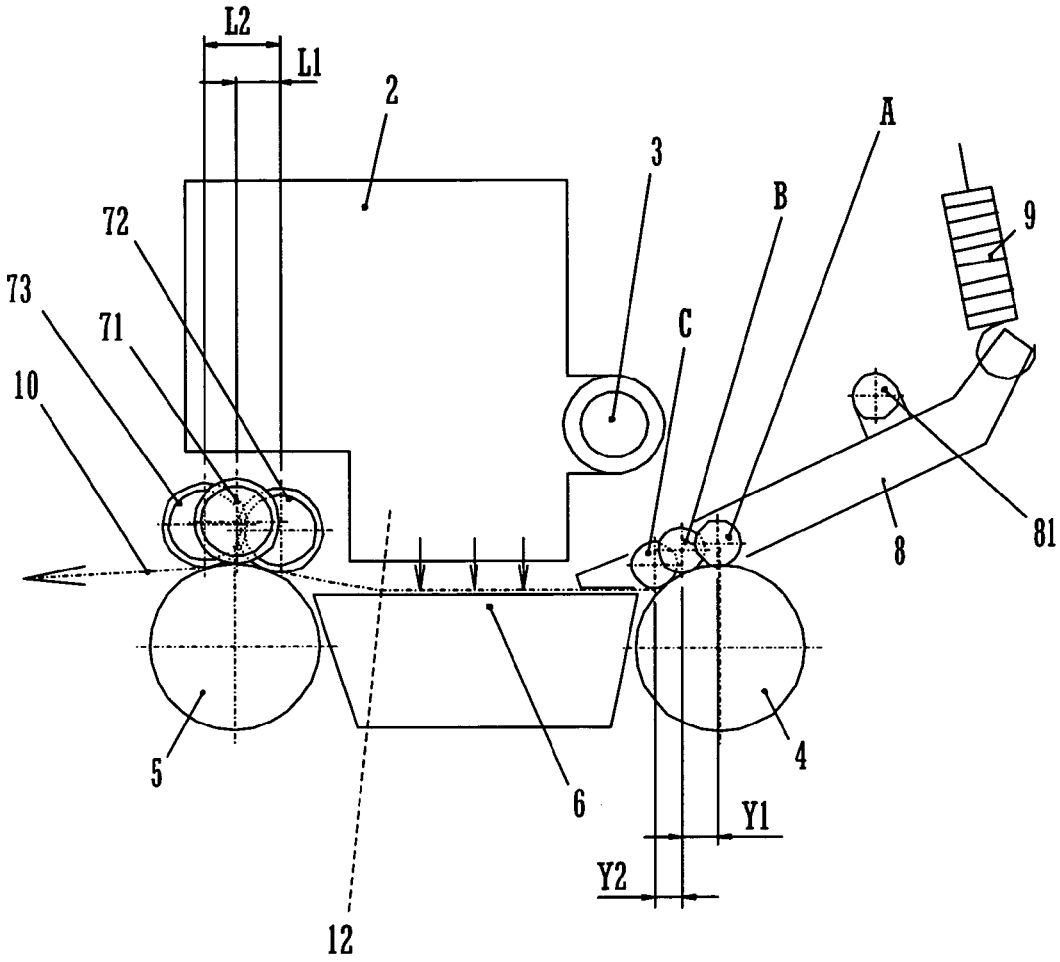
FIG. 2 is a side view showing a portion of concern of the ink jet printer.
Figure 3:
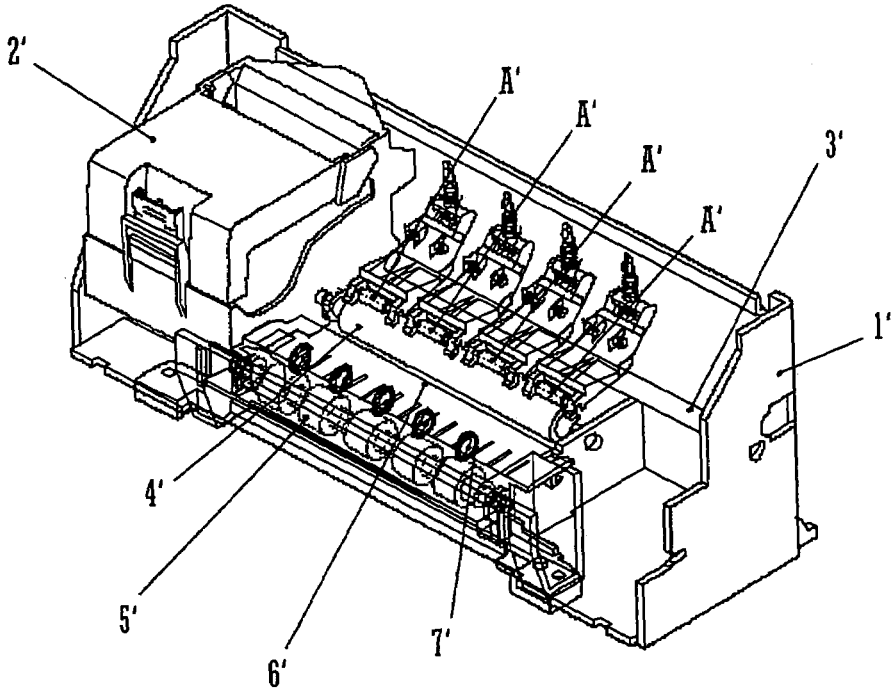
FIG. 3 is a perspective view showing a conventional ink jet printer.
Figure 4:
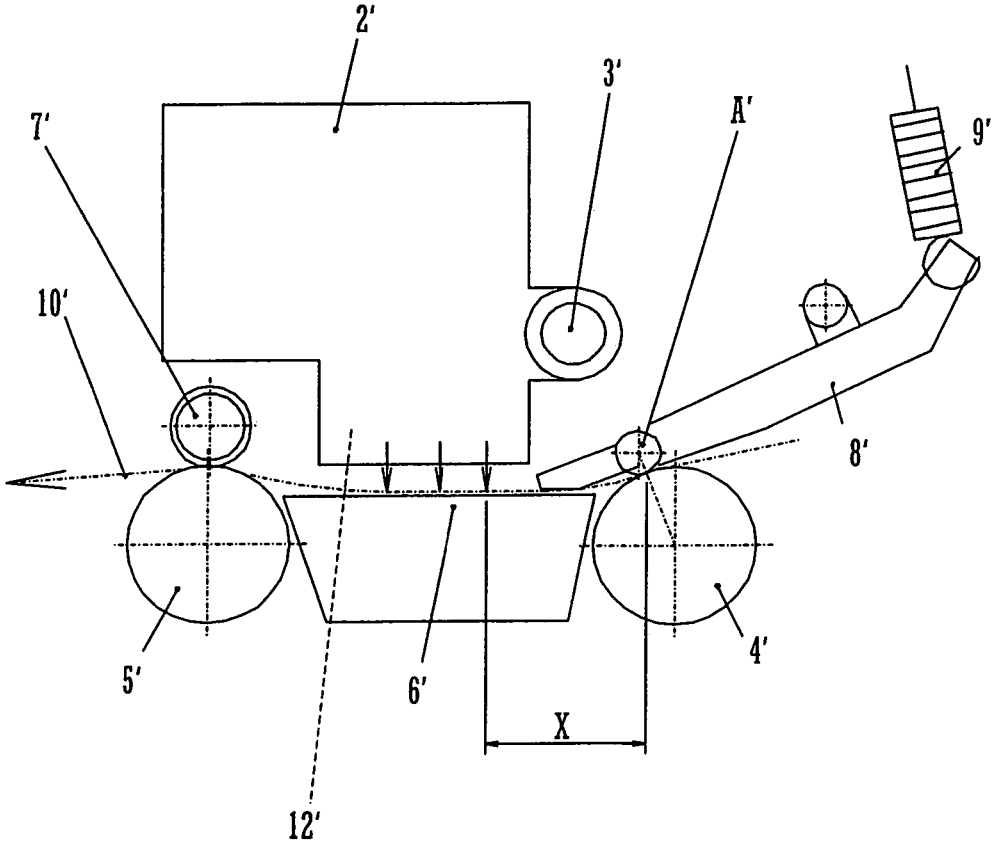
FIG. 4 is a side view showing a portion of concern of the conventional ink jet printer.

FIG. 1 is a perspective view showing an ink jet printer according to an embodiment of the present invention. FIG. 2 is a side view showing a portion of concern of the ink jet printer. In FIG. 2, a recording sheet 10 is fed in the secondary scanning direction toward the left-hand side in the figure by rotation of a non-illustrated pickup roller driven by means of a non-illustrated driving motor and a non-illustrated gear train.

Subsequently, after a non-illustrated sensor has detected the leading edge of the recording sheet 10, the recording sheet 10 is nipped between a first transport roller 4 and first driven rollers A, B and C pressed against the first transport roller 4 and then moved a predetermined distance to reach an image forming position under an ink head 12 disposed downstream in the secondary scanning direction. The ink head 12, which is held by a carriage 2, jets ink while reciprocating in the primary scanning direction orthogonal to the secondary scanning direction, thereby forming an image on the surface of the recording sheet 10.

Such sheet feed operation in the secondary scanning direction and ink-jetting reciprocation of the ink head 12 in the primary scanning direction are performed intermittently. Finally, the recording sheet 10 is ejected out of the apparatus by a second transport roller 5 and second driven rollers 71, 72 and 73 disposed downstream of the ink head 12.

Two first driven rollers A, two first driven rollers B and one first driven roller C are provided for the single first transport roller 4. The first driven rollers A to C are each rotatably supported at one end of a respective one of holders 8. Each of the holders 8 is pivotally supported at its middle portion on a support shaft 81 of the apparatus. One end of a spring 9 is fixed to the other end of the holder 8. The holder 8 and the spring 9 constitute a biasing member defined by the present invention. The biasing force of the spring 9 acts in such a direction as to press each of the first driven rollers A to C against the first transport roller.

A plurality of such biasing members associated with respective of the first driven rollers A to C are arranged in the primary scanning direction. Each of such biasing members may be provided individually for a respective one of the first driven rollers A to C, the total number of which is five, or for a respective one of the pair of first driven rollers A, the pair of first driven rollers B and the single first driven roller C. The two first driven rollers A exert equal biasing forces and, likewise, the two first driven rollers B exert equal biasing forces.

Each biasing member need not necessarily comprise holder 8 and spring 9. The biasing member may be of any other configuration which can exert a biasing force in such a direction as to press the associated one of the first driven rollers A to C against the first transport roller 4.

Nip points between the first transport roller 4 and the first driven rollers A to C are located at different positions in the secondary scanning direction. The nip points between the first transport roller 4 and the first driven rollers A to C are arranged at their respective positions in the secondary scanning direction in such a manner as to take respective positions in the primary scanning direction which are substantially symmetric with respect to a center line of the recording sheet parallel with the secondary scanning direction. Specifically, the two first driven rollers A are disposed substantially symmetrically with respect to a center position of the recording sheet lying in the primary scanning direction at the most upstream position in the secondary scanning direction. Similarly, the two first driven rollers B are disposed substantially symmetrically with respect to the center position of the recording sheet lying in the primary scanning direction at an intermediate position in the secondary scanning direction. Further, the single first driven roller C is disposed at the center position of the recording sheet lying in the primary scanning direction at the most downstream position in the secondary scanning direction.

Two second driven rollers 71, two second driven rollers 72 and one second driven roller 73 are provided for the single second transport roller 5. The second driven rollers 71, 72 and 73 are disposed at their respective positions in the secondary scanning direction. The two second driven rollers 72 are disposed in the primary scanning direction at the most upstream position.

Nip points between the second transport roller 5 and the second driven rollers 71 to 73 are located at different positions in the secondary scanning direction. The nip points between the second transport roller 4 and the second driven rollers 71 to 73 are arranged at their respective positions in the secondary scanning direction in such a manner as to take respective positions in the primary scanning direction which are substantially symmetric with respect to the center line of the recording sheet parallel with the secondary scanning direction. Specifically, the two second driven rollers 72 are disposed substantially symmetrically with respect to the center position of the recording sheet lying in the primary scanning direction at the most upstream position in the secondary scanning direction. Similarly, the two second driven rollers 71 are disposed substantially symmetrically with respect to the center position of the recording sheet lying in the primary scanning direction at an intermediate position in the secondary scanning direction. Further, the single second driven roller 73 is disposed at the center position of the recording sheet lying in the primary scanning direction at the most downstream position in the secondary scanning direction.

The second driven rollers 71 to 73 are biased by means of individual non-illustrated biasing members in such a direction as to press against the second transport roller 5. Each of such biasing members may be provided individually for a respective one of the second driven rollers 71 to 73, the total number of which is five, or for a respective one of the pair of second driven rollers 71, the pair of second driven rollers 72 and the single second driven roller 73. The two second driven rollers 71 exert equal biasing forces and, likewise, the two second driven rollers 72 exert equal biasing forces.

During a series of feeding operations on the recording sheet 10, first, the first transport roller 4 feeds the recording sheet 10 to an image formation start position where the ink head 12 forms an image on the recording sheet 10. Thereafter, when the recording sheet 10 is fed a predetermined distance, the leading edge of the recording sheet 10 rushes to the nip points between the second transport roller 5 and the second driven rollers 72. At that moment, the recording sheet 10 is subjected to some load fluctuations by the pressing force of the second driven rollers 72. Since the second driven rollers 72 are formed of two of the five second driven rollers, load fluctuations on the recording sheet 10 are relatively small.

In this embodiment, after the leading edge of the recording sheet 10 has passed between the second driven rollers 72 and the second transport roller 5, the leading edge is caught between the second transport roller 5 and the two second driven rollers 71 spaced a distance L1 apart from the second driven rollers 72 downstream in the secondary scanning direction and then, finally, caught between the second transport roller 5 and the single second driven roller 73 spaced a distance L2 apart from the second driven rollers 72 downstream in the secondary scanning direction.

Since the recording sheet 10 is caught in three steps sequentially as the leading edge thereof advances through the group of second driven rollers 71 to 73 as described above, the recording sheet 10 is subjected to reduced load fluctuations. For this reason, the precision with which the recording sheet 10 is fed is less influenced and, hence, degradation in image quality such as image formation irregularity can hardly occur at the moment the leading edge of the recording sheet 10 advances into the group of second driven rollers 71 to 73, so that a satisfactory image quality is ensured.

On the other hand, as the image forming operation in both the secondary scanning direction and the primary scanning direction continues, the trailing edge of the recording sheet 10 reaches the nip points of the first transport roller 4. The first driven rollers A to C are arranged in this order as spaced from each other by a distance Y1 and a distance Y2 in the secondary scanning direction. Each of the first driven rollers A to C is rotatably supported by a respective one of the holders 8 and exerts a pressing force on the first transport roller 4 by means of spring 9 through the holder 8 pivoting about its support shaft 81. Also, the first driven rollers A to C are disposed in such a manner that the two pairs of the first driven rollers including the first driven rollers A and the first driven rollers B are arranged symmetrically with respect to the first driven roller C in the primary scanning direction, as shown in FIG. 1.

With this arrangement, as the image forming operation continues, the trailing edge of the recording sheet 10 first leaves the two nip points between the first driven rollers A and the first transport roller 4 and, at that time, the trailing edge portion of the recording sheet 10 is nipped at the nip points between the two first driven rollers B and the first transport roller 4 and between the single first driven roller C and the first transport roller 4. Subsequently, the trailing edge of the recording sheet 10 leaves the nip points between the two first driven rollers B and the first transport roller 4 and, at that time, the trailing edge portion of the recording sheet 10 is still nipped at the nip point between the single first driven roller C and the first transport roller 4. Finally, the trailing edge of the recording sheet 10 is released from the nip point between the first driven roller C and the first transport roller 4 and, accordingly, the recording sheet 10 is fed in the secondary scanning direction by means of the second transport roller 5 and the second driven rollers 71 to 73 only.

The image forming operation is further continued until the end position of the image forming region (about 3 mm apart from the trailing edge of the recording sheet 10 in this embodiment) is found to be reached by a trailing edge detection signal from a non-illustrated sheet sensor.

During the above-described image forming operation on a portion of the recording sheet 10 adjacent the trailing edge thereof, the pressing force on the trailing edge of the recording sheet 10 is dividedly released in three steps sequentially and, accordingly, the nipping force and feeding force working on the recording sheet 10 also vary stepwise. For this reason, load fluctuations that occur at the moment the trailing edge of the recording sheet 10 is released from the nipping force of the first transport roller 4 also vary stepwise, whereby the occurrence of such a phenomenon that the feed precision is disturbed in a moment can be prevented. Thus, a satisfactory image quality can be ensured.

As a method of further suppressing load fluctuations that occur at the moment the leading edge portion of the recording sheet 10 rushes to the second transport roller 5 and at the moment the trailing edge portion of the recording sheet 10 is released from the first transport roller 4, it is possible to provide differences in pressing force between the first driven rollers A to C and between the second driven rollers 71 to 73 thereby to obtain a more smooth variation in feed precision.

The pressing forces of the groups of the first driven rollers A to C are established such that a group consisting of a single or plural first driven rollers taking the same position in the sheet feed direction exerts a total pressing force on the first transport roller 4 which decreases as the location of that group goes downstream in the sheet feed direction. For example, the pressing forces PA, PB and PC of respective of the first driven rollers A, B and C are established to satisfy the relationship: 2 PA>2 PB>PC.

On the other hand, the pressing forces of the plural second driven rollers 71 to 73 are established such that a most upstream one of the groups of second driven rollers in the sheet feed direction exerts a smallest total pressing force on the second transport roller, the groups each consisting of a single or plural second driven rollers taking the same position in the sheet feed direction. For example, the pressing forces P71, P72 and P73 of respective of the second driven rollers 71, 72 and 73 are established to satisfy the relationship: 2P72<2P71<P73.

It is to be noted that the arrangement orders and numbers of the first driven rollers A to C and second driven rollers 71 to 73 are not limited to the foregoing embodiment.

The invention claim is:

1. An ink jet printer comprising: a first transport roller to be driven in a sheet feed direction in which a recording sheet is to be fed; plural first driven rollers configured to press the recording sheet against the first transport roller to nip the recording sheet therebetween; a second transport roller to be driven in the sheet feed direction at location downstream of the first transport roller in the sheet feed direction; plural second driven rollers configured to press the recording sheet against the second transport roller to nip the recording sheet therebetween; and an ink head configured to jet ink against the recording sheet while moving in a direction orthogonal to the sheet feed direction between the first transport roller and the second transport roller in the sheet feed direction, the jetting of ink against the recording sheet by the ink head being continued even after passage of a trailing edge of the recording sheet between the first transport roller and the first driven rollers, wherein:

biasing members, each configured to exert a biasing force on a respective one of the plural first driven rollers in such a direction as to press the respective one of the plural first driven roller against the first transport roller, are disposed at different positions in the direction orthogonal to the sheet feed direction; and nip points between the first transport roller and the first driven rollers are located at respective positions in the sheet feed direction in such a manner as to take respective positions in the direction orthogonal to the sheet feed direction which are substantially symmetric with respect to a center line of the recording sheet parallel with the sheet feed direction.

2. The ink jet printer according to claim 1, wherein the biasing forces of the plural biasing members are established such that a group consisting of a single or plural first driven rollers taking the same position in the sheet feed direction exerts a total pressing force on the first transport roller which decreases as the location of the group goes downstream in the sheet feed direction.

3. The ink jet printer according to claim 1, wherein the plural second driven rollers are disposed at different positions in the sheet feed direction and plural second driven rollers are arranged in the direction orthogonal to the sheet feed direction at least a most upstream one of the different positions.

4. The ink jet printer according to claim 3, wherein the pressing forces of the plural second driven rollers are established such that a most upstream one of groups of second driven rollers in the sheet feed direction exerts a smallest total pressing force on the second transport roller, the groups each consisting of a single or plural second driven rollers taking the same position in the sheet feed direction.

* * * * *